United States Patent [19]

Folkins

[11] Patent Number: 4,868,907

[45] Date of Patent: Sep. 19, 1989

[54] SELF-BIASED SCOROTRON GRID POWER SUPPLY AND ELECTROSTATIC VOLTMETER OPERABLE THEREFROM

[75] Inventor: Jeffrey J. Folkins, Rochester, N.Y.

[73] Assignee: Zerox Corporation, Stamford, Conn.

[21] Appl. No.: 195,320

[22] Filed: May 18, 1988

[51] Int. Cl.[4] ..... G05F 1/652

[52] U.S. Cl. ..... 323/231; 361/212; 361/230; 361/235; 250/324

[58] Field of Search ..... 323/221, 231, 233, 903; 361/212, 213, 214, 229, 230, 235, 225; 250/325, 326, 324; 355/14 CH

[56] References Cited

U.S. PATENT DOCUMENTS

| | | | |
|---|---|---|---|
| 3,370,212 | 2/1968 | Frank | 250/326 X |
| 3,769,506 | 10/1973 | Silverberg | 361/229 X |
| 3,921,042 | 11/1975 | Shenoy | 361/230 X |
| 4,233,511 | 11/1980 | Harada et al. | 250/325 |
| 4,433,298 | 2/1984 | Palm | 324/457 |
| 4,603,964 | 8/1986 | Swistak | 355/14 CH |
| 4,618,249 | 10/1986 | Minor | 355/14 CH |
| 4,638,397 | 1/1987 | Foley | 361/212 |
| 4,695,723 | 9/1987 | Minor | 361/230 X |
| 4,714,978 | 12/1987 | Coleman | 361/235 |
| 4,725,732 | 2/1988 | Lang et al. | 250/326 |

*Primary Examiner*—Patrick R. Salce
*Assistant Examiner*—Kristine Peckman
*Attorney, Agent, or Firm*—Mark Costello

[57] ABSTRACT

An electrophotographic system including a corona charging device for applying a charge to a surface and having a coronode driven to a corona producing condition; a conductive grid interposed between the surface to be charged and the coronode; the conductive grid having a self-biasing arrangement to control the voltage thereon produced by corona current from the coronode, the self-biasing arrangement including a current sinking device between the conductive grid and a common; and a power supplying takeoff, electrically connected between the conductive grid and the current sinking device, and having a voltage thereat controlled by the current sinking device. An electrostatic voltmeter drivable by such an arrangement includes a probe for detecting voltage on a surface and producing a representative voltage signal; a low current, high voltage supply such as that available at the conductive grid; a constant current source; a current sinking device connected to the constant current source and having a constant voltage drop thereacross, and providing first and second floating voltages and a relative common therebetween; and a voltage controller variably controlling the voltage level at the current sinking device in response to the representative voltage signal; a signal processing device for conditioning the representative voltage signal for variably controlling the voltage controller; the amplifier driven by the first and second floating voltages.

10 Claims, 2 Drawing Sheets

SELF-BIASED SCOROTRON GRID POWER SUPPLY AND ELECTROSTATIC VOLTMETER OPERABLE THEREFROM

The present invention relates generally to the use of a self-biased scorotron screen as a power supply in an electrophotographic device, and an electrostatic voltmeter drivable by such a power supply.

BACKGROUND OF THE INVENTION

In electrophotographic applications such as xerography, a charge retentive surface is electrostatically charged, and exposed to a light pattern of an original image to be reproduced, to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. The process is well known, and is useful for light lens copying from an original, and printing applications from electronically generated or stored originals, where a charged surface may be discharged in a variety of ways.

It is common practice in electrophotography to use corona charging devices to provide electrostatic fields driving various machine operations. Thus, corona charging devices are used to deposit charge on the charge retentive surface prior to exposure to light, to implement toner transfer from the charge retentive surface to the substrate, to neutralize charge on the substrate for removal from the charge retentive surface, and to clean the charge retentive surface after toner has been transferred to the substrate. These corona charging devices normally incorporate at least one coronode held at a high voltage to generate ions or charging current to charge a surface closely adjacent to the device to a uniform voltage potential, and may contain screens and other auxiliary coronodes to regulate the charging current or control the uniformity of charge deposited. A common configuration for corotron corona charging devices is to provide a thin wire coronode tightly suspended between two insulating end blocks which support the coronode in charging position with respect to the photoreceptor and also serve to support connections to the high voltage source required to drive the coronode to corona producing conditions. Alternatively a pin array coronode may be provided, which substitutes an array of corona producing pin tips for the wire coronode, as shown for example in US-A4,725,732 to Lang et al. Scorotron corona charging devices have a similar structure, but are characterized by a conductive screen or grid interposed between the coronode and the photoreceptor surface, and biased to a voltage corresponding to the desire charge on the photoreceptor surface. The screen tends to share the corona current with the photoreceptor surface. As the voltage on the photoreceptor surface increases towards the voltage level of the screen, corona current flow to the screen is increased, until all the corona current flows to the screen and no further charging of the photoreceptor takes place. For this reason, scorotrons are particularly desirable for applying a uniform charge to the charge retentive surface preparatory to imagewise exposure to light.

In use, scorotron grids are commonly self-biased from corona current, by connecting the screen to a ground arrangement through current sink devices, such as discussed in US-A4,638,397 to Foley. In that particular example, a Zener diode and variable impedance device are arranged in series between the grid and ground and selected and set to maintain a selected voltage at the grid. US-A4,233,511 to Harada et al., and US-A4,603,964 to Swistak similarly disclose self-biasing scorotrons. Arrangements which adjust the bias applied to optimize the charging function are demonstrated in US-A4,618,249 to Minor and US-A4,638,397 to Foley.

In electrophotographic systems, it is commonly required to provide power supplies supplying a high voltage and low current to operate various devices within a machine. Examples of a devices requiring such power supplies are the developer bias arrangement or a closed loop electrostatic voltmeter (ESV) arrangement, typically used to measure photoreceptor voltage, and which may drive a feedback arrangement for controlling the voltage applied to the photoreceptor. In closed loop ESV's, a reference voltage is varied in accordance with the detected difference between this reference voltage and the photoreceptor voltage. This absolute reference voltage is then measured to determine the voltage on the photoreceptor. A significant cost in such devices is a high voltage power supply to drive the device, and a floating low voltage power supply to drive the feedback electronics, which usually requires a power supply with an oscillator-driven transformer to provide the bias voltage required. Such a circuit is a high cost item because of the inherent cost of transformers. Additionally transformers cannot be made on a low cost semiconductor device. In addition to the cost of such a device, the power supply also takes up space in a compact area. US-A4,714,978 to Coleman shows a power supply for an A.C. corotron which provides a feedback control of the power supply in accordance with variations in corona current. US-A4,433,298 to Palm describes a closed loop feedback arrangement with an ESV controlling various devices in an electrophotographic device. In the Xerox 3300 copier, the developer bias was driven from the corotron power supply through a very large, high power resistor to avoid the need for an extra power supply. All of the references cited herein and above are incorporated by reference herein for their teachings.

SUMMARY OF THE INVENTION

In accordance with the invention there is provided an arrangement for providing a power supply device in an electrophotographic system using the self-biased grid of a scorotron charging device.

In accordance with one aspect of the invention, a self-biased scorotron, having a grid voltage controlled by passive current sink elements provides a high voltage, low current power supply which may be used for devices having such power requirements.

In accordance with yet another aspect of the invention, a low power electrostatic voltmeter ESV is provided, drivable by using the high voltage, low current power supply available from the scorotron self-biasing arrangement. The high voltage input is fed to a constant current sink. The voltage after the sink is controlled by a high voltage controller, and is used to power the probe feed back voltage. Low voltage power which is floating relative to the high voltage from the scorotron grid is used to supply the ESV probe electronics. Thus, floating low voltage is derived from the high voltage source by inserting a current sinking, fixed voltage device between the high voltage controller and the high voltage source. This provides a floating low voltage current capability nearly equal to the high voltage current sink current.

By using the self-biased scorotron grid as a power supply, a device incorporating the invention requires fewer expensive power supplies. The advantage of the described ESV is that current requirements are low enough to be met by the scorotron power supply arrangement, and the power driving the ESV is obtained directly from the high voltage and does not require special floating power supply, and thus, no transformer-/oscillator combination. The arrangement also allows a compact circuit arrangement in a relatively small area.

These and other aspects of the invention will become apparent from the following description used to illustrate a preferred embodiment of the invention read in conjunction with the accompanying drawings in which.

Figure 1:
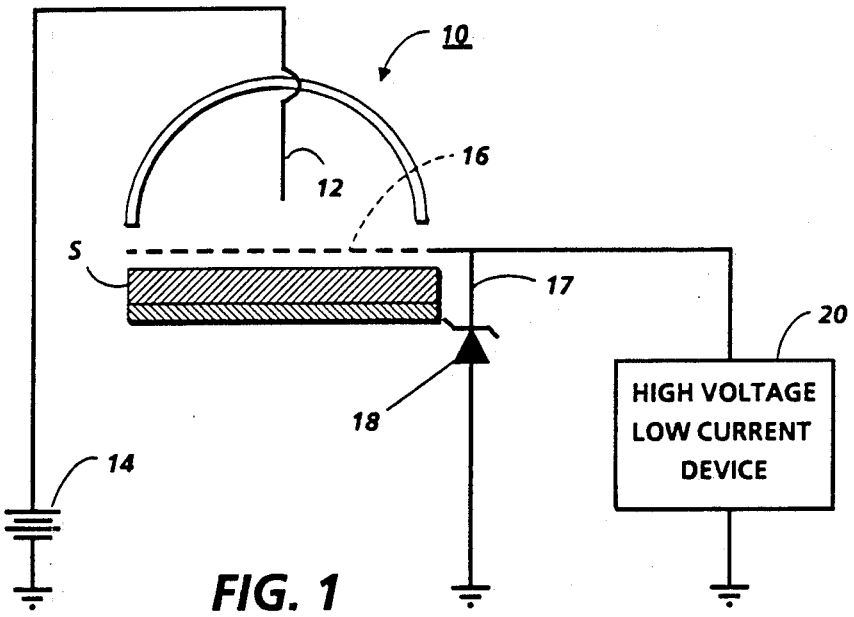
FIG. 1 is a schematic drawing demonstrating the use of a self-biased scorotron grid as a power supply for a low current, high voltage requirement device.

Referring now to the drawings, where the showings are for the purpose of describing a preferred embodiment of the invention and not for limiting same, FIG. 1 demonstrates the use of a self-biased scorotron grid as a power supply for a low current, high voltage requirement device. Accordingly, scorotron 10 for charging a photoreceptor surface S is provided with a coronode 12 such as a pin array or wire, driven to corona producing voltages with high voltage power supply 14. A conductive grid 16 is interposed between surface S and coronode 12 for the purpose of controlling the charge deposited on surface S. To maintain the desired voltage level on grid 16, which is selected to be the voltage level desired on surface S, grid 16 is connected to a ground potential via ground line 17 including a current sink device such as Zener diode 18. The Zener diode is selected with a breakdown voltage equal to the voltage desired at the grid. Of course, various combinations of current sink devices, as described for example in US-A4,638,397 to Foley, could be used to similar effect.

In accordance with the invention, a low current, high voltage requirement device 20 may be driven from the scorotron grid by connection to the ground line 17 thereof. Depending upon the voltage desired across device 20, the device may be connected to the ground line 17 between any current sinking device 18 and the grid, or, with the selection of multiple current sinking devices 18, device 20 may be connected along the ground line 17 between devices 18 having different voltage drops there across, to selectively obtain a desired voltage. The grid current produced by a typical pin scorotron device is about 1.5 milliamps.

In an alternative embodiment, which one skilled in the art would no doubt appreciate from the description herein, a corotron is in certain cases provided with a conductive shield which is self biased to a selected voltage. In such a case, the conductive shield may be used as the low current, high voltage source in substitution for the field. For the self biasing feature, and thus, the inventive power supply, to be operative, a substantial D.C component is required.

Figure 2:
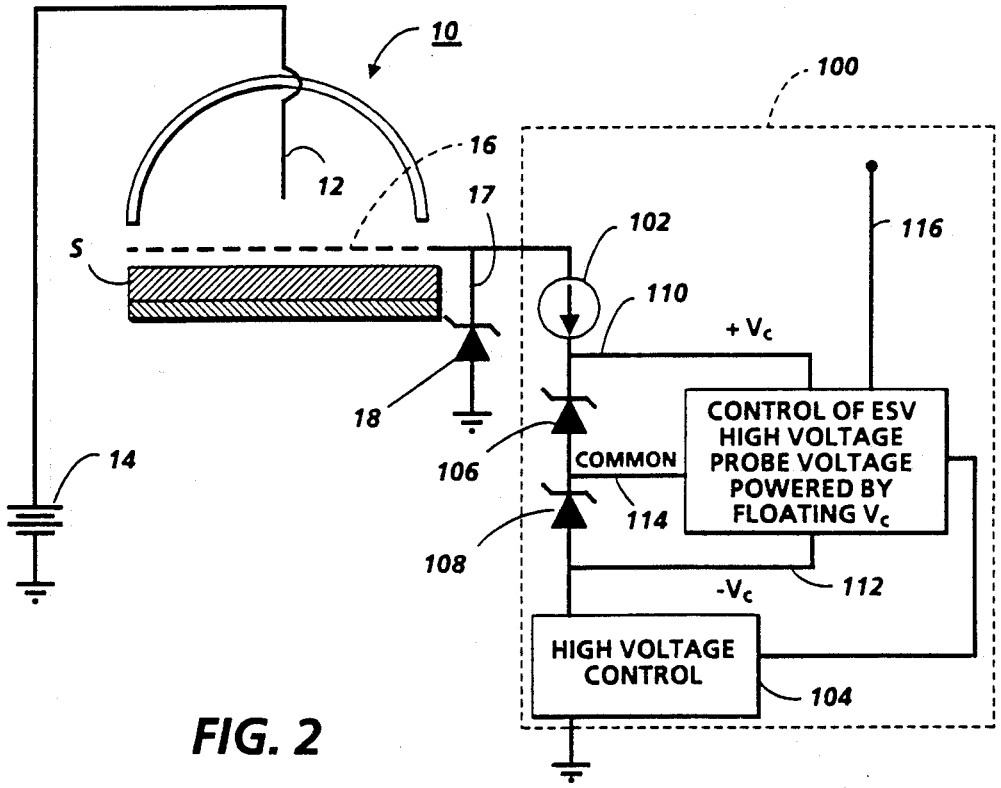
FIG. 2 is a schematic drawing which shows the use of the self-biased scorotron grid as a power supply for a low current, high voltage ESV.

In accordance with another aspect of the invention and with reference to FIG. 2, scorotron 10, with a grid 16 self-biased to a selected voltage level with Zener diode 18 in ground line 17, is useful to provide a power supply to an ESV device. The ESV circuit, generally indicated as 100, obtains power from the scorotron grid through constant current sink 102. The constant current sink may be connected to a high voltage control 104, which in effect is a variable resistance, through a pair of Zener diodes 106, 108, Floating low voltage signals may be taken from the Zener diodes 106, 108 to provide floating low voltage levels $+V_c$ at line 110 between Zener diode 106 and constant current sink 102, $-V_c$ at line 112 between Zener diode 108 and high voltage control 104 and a relative ground at line 114 between Zener diodes 106 and 108. The $\pm V_c$ signal is established to provide the bias signal required for the lower power operational amplifiers typically found in probe electronics 116. The high voltage control 104 controls the voltage drop across the Zener diode and current sink combination. Line 118 represents the output from a voltage sensing probe (not shown).

Figure 3:
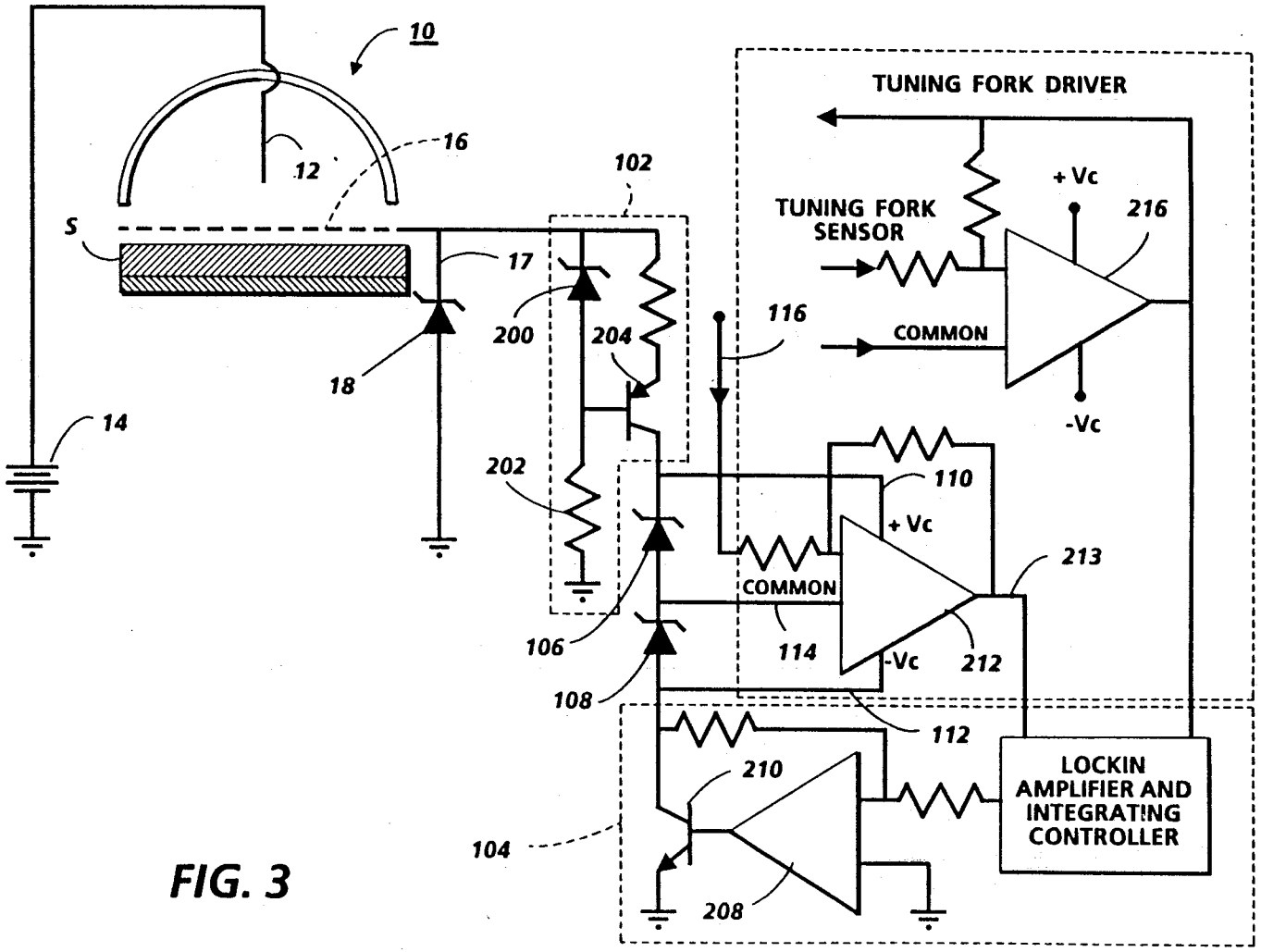
FIG. 3 is a schematic drawing that shows an ESV circuit suitable for use in a low current, high voltage application.

In FIG. 3, a detailed embodiment of such an arrangement is shown. Scorotron 10, with a grid 16 self-biased to a selected voltage level with Zener diode 18 in ground line 17, is useful to provide a power supply to an ESV device. Constant current sink 102 includes a Zener diode 200 in series with a resistance 202 connected to ground. The voltage across resistor 202 is applied to the base lead of pnp transistor 204. The emitter lead of transistor 204 is connected to the high voltage power source (the scorotron screen in this case) through resistor 206. The collector lead of transistor 204 is then connected to the cathode of Zener diode 106. High voltage control 104 may have an operational amplifier 208, the output of which controls current through npn transistor 210 by driving the base of transistor 210, and which amplifies the voltage signal from the voltage detecting sensor probe, as will be explained further below.

Floating low voltage signals $+V_c$ at line 110 and $-V_c$ at line 112 drive probe electronics 116, including an operational amplifier 212 connected at lead 118 to the output of a tuning fork type probe, such as the NEC Model NMU-17D produced by Nippon Electric Company of Japan. The reference lead of the amplifier is connected to the floating common at line 114. An amplified output at line 213, indicative of detected probe voltage, drives the high voltage control arrangement 104. The signal may be conditioned with a lock in amplifier and integrating controller 214 or other common controller type functions.

Floating low voltage signals $+V_c$ and $-V_c$ also drive operational amplifier 216, which serves the dual purpose of driving the tuning fork probe and supplying a timing signal to lock in amplifier and integrating controller 214 in accordance with when the probe is in operation. A grounded input lead to operational amplifier 216 is from the floating ground.

It is a significant advantage of the arrangement that, in comparison to prior art ESV's, because it avoids the requirement of a transformer, the described high voltage, low power ESV may be manufactured on a single common semiconductor substrate. Of course, it will no doubt be appreciated that the described ESV arrangement has merit beyond its described use with the scorotron grid power supply, and is useful in conjunction with other high voltage, low current power supplies.

The invention has been described with reference to a preferred embodiment. Obviously modifications will occur to others upon reading and understanding the specification taken together with the drawings. This embodiment is but one example, and various alternatives modifications, variations or improvements may be made by those skilled in the art from this teaching which are intended to be encompassed by the following claims.

I claim:

1. An electrophotographic system including a corona charging device for applying a charge to a surface and having a coronode driven to a corona producing condition with a power supply having a D.C. component; a conductive member arranged adjacent to the coronode; the conductive member having a passive self-biasing arrangement to control the voltage thereon produced by corona current from the coronode, the self-biasing arrangement including a current sinking device between the conductive member and a ground; and means for providing a low current, high voltage power supply, comprising:

a power supplying takeoff, electrically connected to the conductive member and said current sinking device, and having a voltage thereat controlled by the current sinking device.

2. The electrophotographic system as described in claim 1 wherein said current sinking device includes at least one Zener diode.

3. The electrophotographic system as described in claim 1 wherein said current sinking device includes a plurality of current sinking elements in series combination, and said power supplying takeoff is electrically connected between the conductive member and one of said current sinking elements.

4. The electrophotographic system as described in claim 3 wherein said current sinking device includes at least one Zener diode.

5. The electrophotographic system as described in claim 1 wherein said conductive member is a conductive grid interposed between said surface to be charged and said coronode.

6. An electrophotographic system including a corona charging device for applying a charge to a surface and having a coronode driven to corona producing voltages; a conductive member arranged adjacent to the coronode; the conductive member having a passive self-biasing arrangement to control the voltage thereon produced by corona current from the coronode and including a current sinking device between the conductive member and a ground, and a surface voltage measuring device comprising:

a probe for detecting voltage on said surface and producing a representative voltage signal;

a low current, high voltage supplying takeoff, electrically connected to said conductive member and said current sinking device, and having a voltage thereat controlled by the current sinking device;

a constant current source, connected to said low current, high voltage supplying takeoff;

a second current sinking device connected to said constant current source and having a constant voltage drop thereacross, and providing first and second floating voltages with respect to a relative ground to provide appropriate bias voltages for a probe driver for the surface voltage detecting probe;

a voltage controller connected to said second current sinking device and variably controlling the voltage drop at said current sinking device in response to said representative voltage signal;

a signal processing device connected to said voltage controller for conditioning said representative voltage signal for variably controlling said voltage controller;

said signal processing device driven by the first and second floating voltages.

7. A device as defined in claim 6 wherein said current sinking device includes at least first and second current sinking elements, selected to provide a voltage drop across each with respect to a relative ground suitable for driving said signal processing device.

8. The electrophotographic system as described in claim 6 wherein said current sinking device includes at least one Zener diode.

9. A surface voltage measuring device, said surface voltage measuring device comprising:

a low current, high voltage power supply;

a probe for detecting voltage on a surface and producing a representative signal therefrom;

a constant current source, connected to said low current, high voltage supply;

a current sinking device connected to said constant current source and having a constant voltage drop thereacross, and and providing first and second floating voltages with respect to a relative ground to provide appropriate bias voltages for a probe driver for the surface voltage detecting probe;

a voltage controller connected to said second current sinking device variably controlling the voltage drop at said current sinking device in response to said representative voltage signal;

a signal processing device connected to said voltage controller for conditioning said representative voltage signal for variably controlling said voltage controller;

said signal processing device driven by the first and second floating voltages.

10. A device as defined in claim 9 wherein said current sinking device includes at least first and second current sinking elements, selected to provide a voltage drop across each with respect to a relative ground suitable for driving said signal processing device.

* * * * *

UNITED STATES PATENT AND TRADEMARK OFFICE

CERTIFICATE OF CORRECTION

PATENT NO. : 4,868,907

DATED : September 19, 1989

INVENTOR(S) : Jeffrey J. Folkins

It is certified that error appears in the above--identified patent and that said Letters Patent is hereby corrected as shown below:

On the title page:

After Assignee: delete "Zerox" and insert in place thereof --Xerox--

Signed and Sealed this

Tenth Day of July, 1990

*Attest:*

HARRY F. MANBECK, JR.

*Attesting Officer*

*Commissioner of Patents and Trademarks*